US011525188B1

(12) United States Patent
Berman et al.

(10) Patent No.: US 11,525,188 B1
(45) Date of Patent: Dec. 13, 2022

(54) METHOD AND APPARATUS FOR REMOVING ELECTRICALLY CONDUCTIVE COATINGS ON METALLIC SURFACES

(71) Applicant: IBC MATERIALS & TECHNOLOGIES, LLC., Lebanon, IN (US)

(72) Inventors: Solomon Berman, Lebanon, IN (US); Daesung Chong, Lebanon, IN (US); Ashok B. Ramaswamy, Lebanon, IN (US)

(73) Assignee: IBC Materials & Technologies, LLC., Lebanon, IN (US)

( * ) Notice: Subject to any disclaimer, the term of this patent is extended or adjusted under 35 U.S.C. 154(b) by 0 days.

(21) Appl. No.: 17/178,819

(22) Filed: Feb. 18, 2021

Related U.S. Application Data

(60) Provisional application No. 62/980,505, filed on Feb. 24, 2020.

(51) Int. Cl.
*C25F 5/00* (2006.01)

(52) U.S. Cl.
CPC ..... *C25F 5/00* (2013.01)

(58) Field of Classification Search
CPC ..... C25F 5/00
See application file for complete search history.

(56) References Cited

U.S. PATENT DOCUMENTS 10,400,350 B1 * 9/2019 Berman ..... H01J 37/32321

FOREIGN PATENT DOCUMENTS

RU 2467098 C1 * 11/2012

OTHER PUBLICATIONS

Titanium Nitride (https://web.archive.org/web/20201111200625/http://www.enigmatic-consulting.com/semiconductor_processing/CVD_Fundamentals/films/TiN.html; Nov. 11, 2020). (Year: 2020).*

* cited by examiner

*Primary Examiner* — Nicholas A Smith
(74) *Attorney, Agent, or Firm* — Hartman Global IP Law; Gary M. Hartman; Domenica N. S. Hartman

(57) ABSTRACT

A method of removing an electrically conductive coating from a metallic component includes providing an electrolytic cell with the metallic component containing the conductive coating. A DC power supply connected to the cathode and anode is activated to produce a plasma causing the conductive coating to disintegrate. A method of conductive coating removal from a metallic component includes providing an aqueous solution of ammonium citrate, sodium hydrogen carbonate, sodium carbonate, sodium citrate, and/or potassium phosphate as an electrolyte, a cathode and the metallic component with the conductive coating as an anode. A DC power supply connected to the cathode and anode produces a plasma causing the conductive coatings on the metallic component to disintegrate. An apparatus for removing an electrically conductive coating from a metallic component includes an electrolytic containing the metallic component and a DC power supply capable of producing a plasma causing the electrically conductive coating to disintegrate.

21 Claims, 7 Drawing Sheets

METHOD AND APPARATUS FOR REMOVING ELECTRICALLY CONDUCTIVE COATINGS ON METALLIC SURFACES

CROSS-REFERENCE TO RELATED APPLICATIONS

The present U.S. patent application is related to and claims the priority benefit of U.S. Provisional Patent Application Ser. No. 62/980,505, filed Feb. 24, 2020 the contents of which are hereby incorporated by reference in their entirety into the present disclosure.

TECHNICAL FIELD

The present disclosure generally relates to methods of removing conductive coatings on metallic components, such as, but not limited to, tools, such as cutting tools, specialized tools, forging dies, and structural components used in applications such as, but not limited to, engines, automobiles and aircrafts.

BACKGROUND

This section introduces aspects that may help facilitate a better understanding of the disclosure. Accordingly, these statements are to be read in this light and are not to be understood as admissions about what is or is not prior art.

There are many situations wherein an electrically conductive coating, such as, but not limited to, Chromium Nitride (CrN), aluminum chromium nitride (AlCrN), titanium nitride (TiN), titanium aluminum nitride (TiAlN), titanium chromium nitride (TiCrN), titanium chromium aluminum silicon nitride (TiCrAlSiN), and titanium carbon nitride (TiCN) on a metallic component is desired to be removed. For purposes of this disclosure, "electrically conductive' is sometimes simply termed "conductive". Also, for purposes of this disclosure, a component is meant to be a structural component or a physical component of a mechanical system or an implement providing a utility. Those of skill in the art will recognize that the methods and apparatus of this disclosure will apply to a broad range of metallic components. Such situations, namely where an electrically conductive coating on a metallic component has to be removed, include but are not limited to inspection of components where the conductive coating can interfere with the inspection process or techniques, and removing defective or degrading conductive coating in order to put on a fresh conductive coating. Further, in some situations, where multiple layers of conductive coating or other substances exist, one or more of the conductive layers may have to be removed. For purposes of this disclosure, conductive coatings mentioned above may be made from methods such as, but not limited to, physical vapor deposition (PVD) and chemical vapor deposition (CVD).

Methods of such conductive coating removal to date include stripping off a chromium containing and aluminum containing coating from a workpiece with a highly concentrated alkaline solution comprising a strong oxidant. This process is described in U.S. Pat. No. 7,077,918 B2 titled "STRIPPING APPARATUS AND METHOD FOR REMOVAL OF COATINGS ON METAL SURFACES" issued to Rauch et al. on Jul. 18, 2006, the contents of which are incorporated by reference in their entirety into this disclosure. However, the disadvantages of this process are: A satisfactory removal of the layers specified was not possible until a strong oxidant along with a high pH value were used or an electrolytic process was added. The fastest stripping times achieved were in the range from 1-5 hours, which is considered to be a long duration leading to reduced time-efficiency. Further, permanganates are known as highly corrosive and strong oxidizing agent, their use and disposal require special precautionary measures. Thus, the drawbacks of the methods of the above patent ('918 patent) include the comparatively long stripping time for TiAlN, AlCrN and others, the relatively extensive and correspondingly expensive use of chemicals, detection of corrosive damages for some cases, and multi-step process including removal of adhering metal-oxide residues after stripping.

U.S. Pat. No. 9,903,040 B2, titled "METHOD OF STRIPPING NITRIDE COATINGS" issued to Feng et al, on Feb. 27, 2018 describes a method for partially oxidized nitride wear or release coatings from metal workpieces by disrupting surface oxidation layers present on the coatings following use, and causing electrical current to flow from the workpiece and release coating to a counter electrode while the workpiece, release coating and counter electrode are immersed in an aqueous alkaline electrolyte solution. The contents of this Patent No. U.S. Pat. No. 9,903,040 B2 are hereby incorporated by reference in their entirety into this disclosure. The methods of this patent ('040 patent) include strong alkaline conditions and long durations of the order of 1-5 hours.

The process was designed for nickel-chromium alloys. For the treatment, if the surface oxidation layer exists it has to be removed by immersing the workpiece into a concentrated aqueous alkali metal hydroxide solution for less than an hour at 100-120° C.

Thus, there exists an unmet need for methods and apparatus that can be used for removing electrically conductive coatings such as those mentioned above that are faster and less toxic. It is desirable to have environmentally friendly, cost-effective techniques that remove layers of conductive coatings on metallic components or other objects completely or selectively.

SUMMARY

A method of removing electrically conductive coating from a metallic component is disclosed. The method includes providing a tank containing a liquid electrolyte and a cathode immersed in the liquid electrolyte. The metallic component containing the conductive coating is immersed into the liquid electrolyte to act as an anode. A DC power supply is connected to the anode and cathode to form an electrolytic cell capable of producing a plasma on the metallic component with the conductive coating. The DC power supply is activated to produce a plasma on the metallic component with the conductive coating for a duration such that the conductive coating from the metallic component disintegrates into particles partially or fully.

A method of removing a conductive coating on a metallic component is disclosed. The method includes providing a tank containing an aqueous solution of ammonium hydrogen citrate, sodium dihydrogen citrate, and potassium citrate, the aqueous solution acting as liquid electrolyte, and a cathode made of 316 SS immersed in the liquid electrolyte. A metallic component with a conductive coating is immersed into the liquid electrolyte to act as an anode. A DC power supply capable of producing at least 150 volts is connected to the anode and cathode to form an electrolytic cell capable of producing a plasma on the metallic component coated with the conductive layer. The DC power supply is activated to produce a plasma on the coated metallic component for a time period in the range of 3-8 minutes such that the conductive coating on the metallic component disintegrates into particles falling into the liquid electrolyte, thereby resulting in a conductive coating removed metallic component.

An apparatus for removing an electrically conductive coating from a metallic component is disclosed. The apparatus contains a tank containing a liquid electrolyte, a cathode immersed in the liquid electrolyte, a metallic component coated with an electrically conductive material acting as an anode immersed in the liquid electrolyte, and DC power supply connected to the anode and cathode to form an electrolytic cell. The electrolytic cell so formed is capable of producing a plasma on the coated metallic component, such that the electrically conductive coating from the metallic component disintegrates into particles falling into the liquid electrolyte, thereby resulting in metallic component without the electrically conductive coating.

BRIEF DESCRIPTION OF DRAWINGS

While some of the figures shown herein may have been generated from scaled drawings or from photographs that are scalable, it is understood that such relative scaling within a figure are by way of example and are not to be construed as limiting.

DETAILED DESCRIPTION

Figure 1:
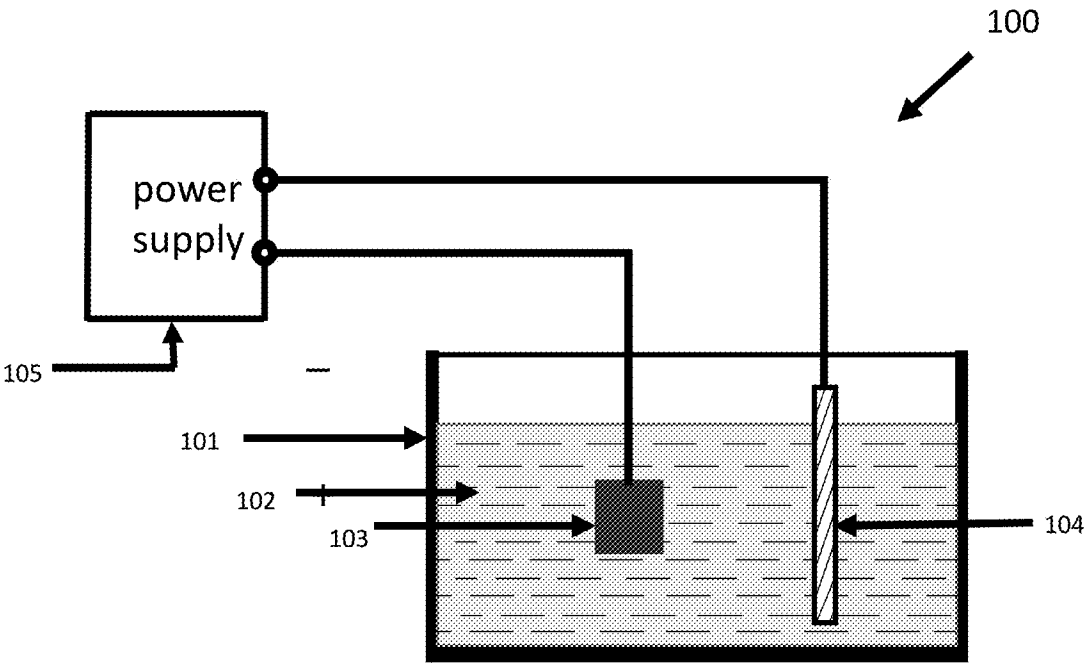
FIG. 1 is a schematic representation of one embodiment of apparatus that can be used for removing electrically conductive coatings according to this disclosure.

For the purposes of promoting an understanding of the principles of the disclosure, reference will now be made to the embodiments illustrated in the drawings and specific language will be used to describe the same. It will nevertheless be understood that no limitation of the scope of the disclosure is thereby intended, such alterations and further modifications in the illustrated device, and such further applications of the principles of the disclosure as illustrated therein being contemplated as would normally occur to one skilled in the art to which the disclosure relates.

In this description an electrically conductive layer is sometimes simply referred to as "conductive layer". Also, an electrically conductive coating is simply referred to as "conductive coating". Further the words "layer" and "coating" are used synonymously. Also used synonymously in this disclosure are "conductive layer" and "conductive coating". The coatings are indicated by their commercially popular names. While the coatings of this disclosure are sometimes referred to as a chemical formula, no particular stoichiometry of the coating composition is implied while the industry represents these coatings by the formula designations indicated here and can in fact reflect the stoichiometry of the coatings described herein.

For purposes of this disclosure, coatings, in the thickness range of 0.1 micrometers to 30 micrometers, that have an electrical resistance less than 1 ohm when measured across the thickness with a cross sectional area of 1 square centimeter are considered to be electrically conductive. In experiments leading to the disclosure, electrical resistances in the range of 0.1 to 1 ohm were measured across the thickness for 1 cm×1 cm test coupons for a component, with a coating thickness in the range of 15 to 30 micrometers. Further, in operation of the coating removal treatment of this disclosure, the current densities measured, which depend on the applied voltage and the electrical conductivity of the coating material, varied from 15 Amperes/square decimeter to 30 Amperes/square decimeter. It should be recognized that the methods and apparatus of this disclosure are applicable to coatings that meet the electrical conductivity requirements described above. The above electrical resistance and current density criteria provide adequate guidance to those skilled in the art regarding selection of coatings amenable to utilization of the methods and apparatus of this disclosure. Those skilled in the art will recognize that the methods and apparatus of this disclosure are designed to work with coatings that satisfy the criteria and when suitable electrolytes and operating voltages are employed as described in this disclosure. The conductivities, and current densities measured, as indicated here, are exemplary and are to be considered non-limiting. Other values for electrical resistance of the coatings and current densities are possible with the same electrolyte compositions as described in this disclosure. Further, other electrolytic compositions may be usable with current densities different from those mentioned above.

FIG. 1 is a schematic representation of one embodiment of an apparatus 100 according to this disclosure for use in removing electrically conductive coatings from a metallic component. The apparatus 100 comprises an electrolytic cell, as described below. Referring to FIG. 1, 101 represents a tank containing a liquid electrolyte 102. A non-limiting example of electrolyte 102 is an aqueous solution with a pH in the range of 5-9. Examples of electrolytes suitable for purposes of this disclosure include but are not limited to aqueous solution of ammonium salts or potassium salts or sodium salts. Salts suitable for this purpose include, but not limited to ammonium chloride, ammonium fluoride, ammonium sulfate, ammonium hydrogen carbonate, ammonium carbonate, ammonium oxalate, ammonium formate, ammonium acetate, ammonium nitrate, ammonium citrate, ammonium hydrogen citrate, ammonium dihydrogen citrate, ammonium phosphate, ammonium hydrogen phosphate, ammonium dihydrogen phosphate, sodium chloride, sodium fluoride, sodium sulfate, sodium hydrogen carbonate, sodium carbonate, sodium oxalate, sodium formate, sodium acetate, sodium nitrate, sodium citrate, sodium hydrogen citrate, sodium dihydrogen citrate, sodium phosphate, sodium hydrogen phosphate, sodium dihydrogen phosphate, potassium chloride, potassium fluoride, potassium sulfate, potassium hydrogen carbonate, potassium carbonate, potassium oxalate, potassium formate, potassium acetate, potassium nitrate, potassium citrate, potassium hydrogen citrate, potassium dihydrogen citrate, potassium phosphate, potassium hydrogen phosphate, and potassium dihydrogen phosphate. It should be noted that the aqueous solution used as the electrolyte can contain more than one salt, such as two, three or more salts. In FIG. 1, 103 represents a metallic component (or part) comprising one or more layers of a conductive coating which is desired to be removed and forms an anode. In case there is more than one layer of the conductive coating, the layers may have same composition or different compositions. In this disclosure the method is described with reference to removal of one layer of conductive coating. It should be recognized that no limitation to a single conductive layer is implied. The method is applicable to removal of multiple conductive layers. In FIG. 1, 104 is a cathode. As a non-limiting example, cathode 104 can be made of stainless steel, a non-limiting example of which is, SS 316. SS 316 is a designation of stainless steel known to those skilled in the art. As a non-limiting example, 103 can be a component made of a steel, with a conductive coating on the component. Those skilled in the art will recognize that sections of the component where the conductive coating is not intended to be removed or not intended to be removed in a process step of this disclosure can be masked without being affected by the coating removal process of this disclosure. Referring again to FIG. 1, 105 represents a DC or pulsed DC power supply suitably connected to the electrodes (anode and cathode) so as to form an electrolytic cell. It should be noted that the methods and apparatuses of this disclosure can utilize DC or pulsed DC. Voltages indicated would refer to peak voltage when pulsed DC is employed.

In operation, a DC or pulsed DC voltage is applied to an electrolytic cell as shown in FIG. 1. Referring again to FIG. 1, under the action of this voltage, a plasma (not shown) is created in the vicinity of the part 103 containing a conducting coating or coatings. The presence of plasma is indicated through a visible electrical discharge and was verified. The plasma so created affects the integrity of adhesion of the conductive layer or layers to the metallic component 103 or the adhesion of one conductive layer to another conductive layer, in cases where there is more than one conductor layer, in such a way that the conductive layer loses adhesion and disintegrates and falls into the electrolyte as particles or agglomerates of particles or chunks of particles. For simplicity, in this disclosure all these three types (particles, agglomerates and chunks) are termed "particles" in this disclosure. For purposes of this disclosure, the terms "disintegration" and "disintegrate" are used to indicate separation of the conductive layer from component. These terms are also used to indicate separation of conductive layers on the components from one another. In some cases, the conductive layer may also dissolve partially or fully into the electrolyte. In some cases, the particles of conductive layer separated from the component may dissolve partially and fully. In cases where the separated particles are not at all dissolved or not fully dissolved, the undissolved particles may be suspended in the electrolyte or settle to the bottom of the tank containing the electrolyte or both. The extent or degree of dissolution and settling and suspension depends on several process conditions such as temperature, relative densities of "particles" and operation parameters of the electrolytic cell. The degree of disintegration of the conductive layer depends on the strength of the plasma, which in turn depends on the voltage applied to the electrolytic cell, the current density of the anode and the duration of the plasma created.

It should be noted that while one anode (the metallic component) and one cathode are shown, it is possible to utilize counter electrodes, thus having more than two electrodes in the electrolytic cell of FIG. 1. The methodology of employing counter electrodes is known to those skilled in the art.

It should be further noted that the apparatus shown in FIG. 1 can be enhanced or modified by including a draining and filtration system for the electrolyte, so that the particles of the disintegrated conductive layer can be captured.

The thickness of the conductive coatings described in this disclosure varies between 0.1 micrometer and 30 micrometers, depending on the particular coating type, and number of layers of the coating, and intended applications for the component. It should be recognized that in the thickness range specified above the methods and apparatus are robust enough and are capable of removing the coating.

Figure 2B:
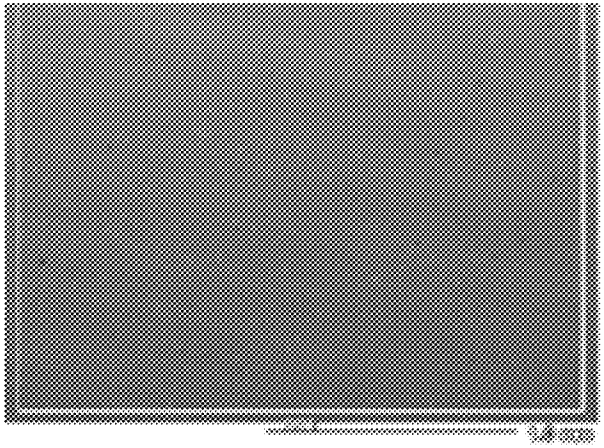
FIGS. 2A and 2B show images of a metallic component made of D2 steel alloy before and after removal of CrN conductive coating, respectively.
Figure 2A:
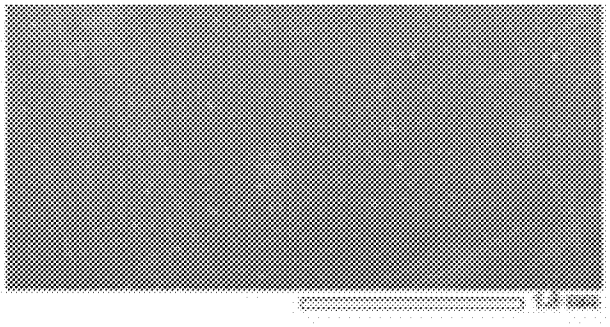

FIGS. 2A and 2B show SEM (Scanning Electron Microscopy) images of a component made of D2 steel alloy, known to those skilled in the art, before and after removal of the conductive layer, respectively. The conductive coating in this case was CrN. The duration of plasma to achieve the surface shown in FIG. 2B was approximately 5 minutes utilizing an aqueous electrolyte solution with pH in the range of 3-9 and applying a voltage over 150 Volts. In this example, the electrolyte used was ammonium hydrogen citrate and sodium dihydrogen citrate, along with water. The percentages of these in the electrolyte were: were: 5 weight % ammonium citrate and 1 weight % sodium dihydrogen citrate, the rest being deionized water. These percentages can vary between 0.01 to 15 weight % for each of the two salts. The strength of a plasma is related to applied voltage and the current density created on the anode. In the experiments leading to this disclosure, the current density on the anode varied between 16 to 28 Amperes/square decimeter. It should be noted that, in the methods of this disclosure, shorter and longer times for the removal of a conductive layer are possible depending on the thickness of the conductive layer or layers, composition of the conductive layer, for the duration of the plasma to achieve acceptable results. In this disclosure, the above-described conductive coating removal process will be referred to as Plasma Electrolytic Conductive Coating Removal process (PECCR), and the conductive layer removal method as PECCR treatment.

As mentioned earlier, FIG. 2A represents a surface SEM image of a part made of D2 steel with a conductive layer. FIG. 2B shows a surface SEM image of the part in FIG. 2A after subjecting the part to the PECCR treatment of this disclosure. From FIG. 2B, it can be seen that there is no conductive coating layer after subjecting the part to the PECCR treatment of this disclosure. EDS analysis of the part in FIG. 2A revealed presence of Chromium and Nitrogen while that of the part in FIG. 2B, after being subjected to the PECCR treatment of this disclosure indicated absence of nitrogen and any presence of chromium was attributable to the chromium contained in the steel.

In other experiments the results of which are described below PECCR treatment included appropriate selection of electrolyte composition and the electrolytic cell parameters. These can be determined for each individual case by those skilled in the art based on the guidance and details provided in this disclosure.

Figure 3B:
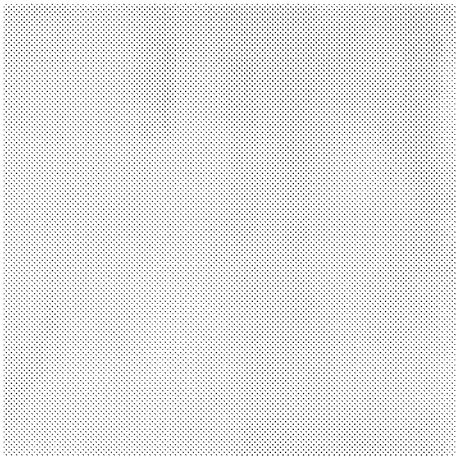
FIGS. 3A and 3B show images of a metallic component made of steel alloy before and after removal of TiCrAlSiN conductive coating, respectively.
Figure 3A:
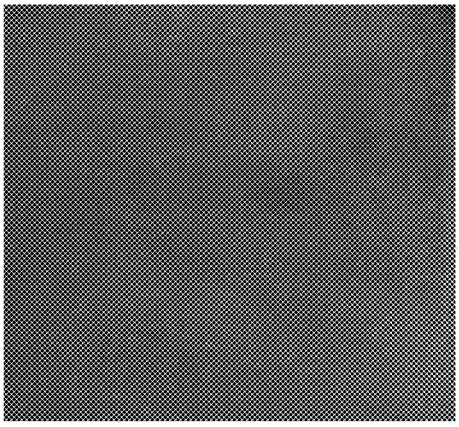

FIG. 3A shows an optical image of a segment of a cross section of a component made of D2 steel alloy containing TiCrAlSiN conductive coating. FIG. 3B shows a cross-sectional optical microscopy image of the regions corresponding to FIG. 3A after PECCR treatment is completed, showing that the conductive layer of TiCrAlSiN has been removed utilizing the process and apparatus of this disclosure as described above.

Figure 4B:
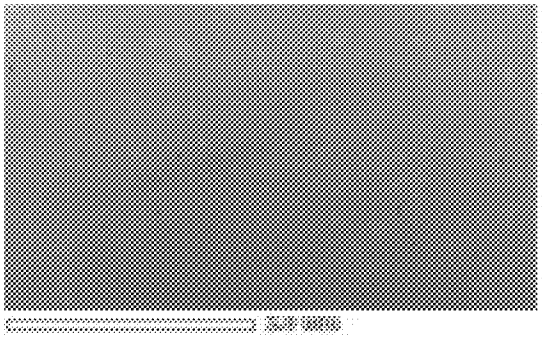
FIG. 4B is an SEM image of the surface shown in FIG. 4A after subjecting to PECCR treatment, after conductive coating has been removed
Figure 4A:
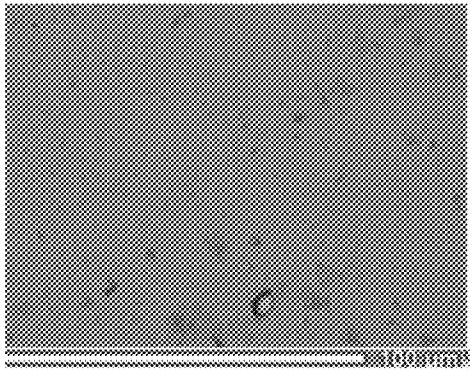
FIG. 4A shows a Scanning Electron Microscope (SEM) image of an electrically conductive layer of TiCrAlSiN on the surface of a component made of D2 steel alloy prior to PECCR (Plasma Electrolytic Conductive Coating Removal) process of this disclosure.

FIG. 4A shows a Scanning Electron Microscope (SEM) image of an electrically conductive layer of TiCrAlSiN on the surface of a component made of D2 steel alloy prior to PECCR treatment. The surface had a high level of metal oxides verified through Energy Dispersive Spectroscopy (EDS) analysis). X-ray Diffraction pattern analysis of parts with conductive coating before PECCR treatment detected the presence of many elements and compounds contained in the conductive coating. FIG. 4B is an SEM image of the surface shown in FIG. 4A after subjecting to PECCR treatment, after conductive coating has been removed. EDS spectra reveled that the coating has been completely removed.

Figure 5B:
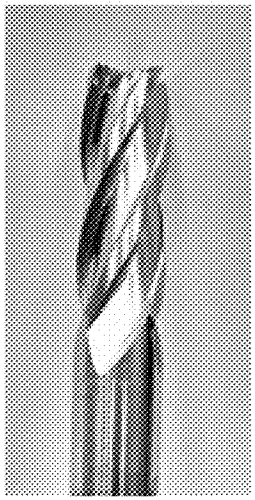
FIGS. 5A and 5B are photo images of an AlCrN coated drill surface of high-speed steel (HSS) before and after subjecting to PECCR treatment.
Figure 5A:
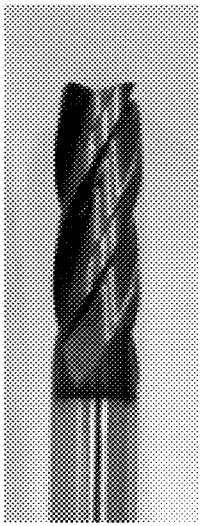

FIG. 5A shows a high-performance drill bit made of a high-speed steel containing a conductive layer AlCrN. As mentioned earlier, such coatings are generally applied utilizing processes such as PVD process to enhance the life of such tools. After significant use and wear and tear, the integrity of the coating is compromised, and the part requires to be recoated. Stripping the coating before applying a conductive coating is needed and can be accomplished by the PECCR treatment of this disclosure. FIG. 5B shows the same part in FIG. 5A after, the conductive layer has been removed utilizing the PECCR treatment of this disclosure, exposing the base steel substrate on which the original conductive layer was adhering, showing that integrity of base steel substrate has been preserved.

Figure 6B:
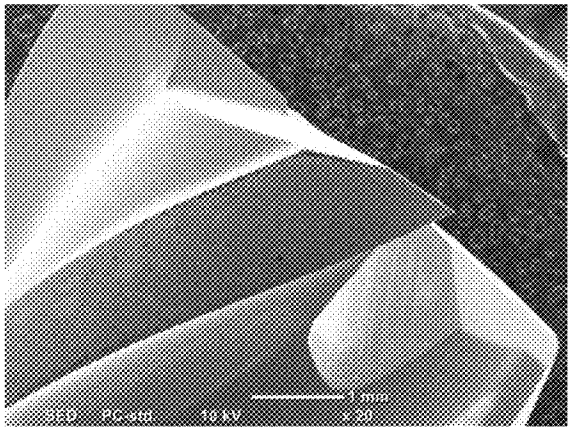
FIGS. 6A and 6B show magnified images (using SEM) of representative sections of the part made of HSS shown in FIGS. 5A and 5B.
Figure 6A:
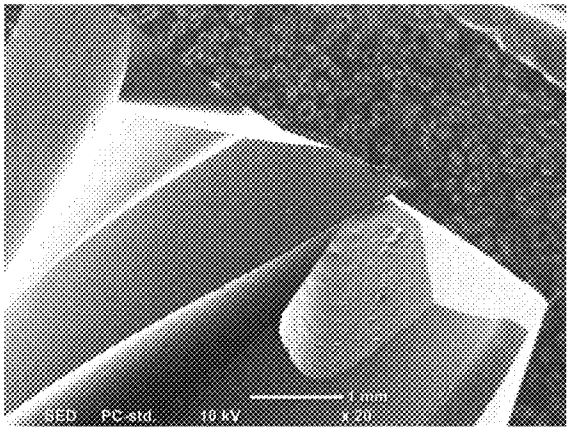
Figure 7B:
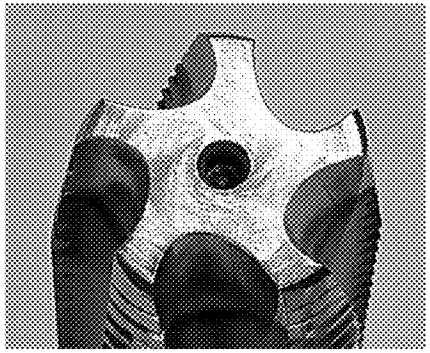
FIGS. 7A and 7B are photo images showing representative areas of conductive coating (TiCrN) removed from a metallic component.
Figure 7A:
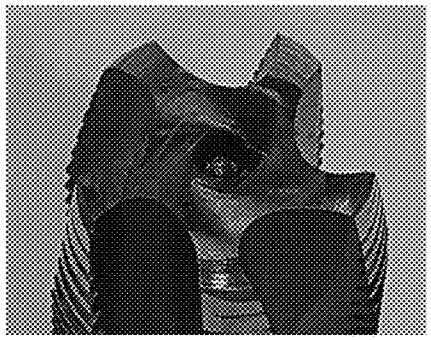

FIGS. 6A and 6B show magnified images (using SEM) of representative sections of the part made of HSS shown in FIGS. 5A and 5B. FIGS. 7A and 7B are photo images of another tool coated with TiCrN before removal of the coating from the component (FIG. 7A) and representative area of the same component after removal of the conductive coating utilizing the PECCR treatment of this disclosure.

It should be noted that, for a given size of the metallic component and its composition, by proper selection of, among other things, the combination of voltage for electrolytic cell of this disclosure, the composition of the electrolyte for the electrolytic cell of this disclosure, and the plasma duration in the PECCR treatment, effective removal of conductive later or layers on the metallic component of interest can be achieved. By a proper combination of the electrolytic cell voltage and plasma duration, conductive layers can be removed selectively, without damaging the integrity of base substrate prevailing in, for example, D2 steel as the base alloy. Similarly, by such control, conductive layers can be removed selectively, without damaging the integrity of binders prevailing in, for example, when certain substrates such as Tungsten carbide (WC) are the base substrates.

In cases where there is more than one conductive layer on a metallic component and it is desired to remove only the layer on the surface of the component without affecting the layer or layers underneath the surface layer, the methods and apparatus of this disclosure can be used. This is accomplished by adjusting the parameters such as, but not limited to electrolyte composition (in terms of both ingredients and percentages), the pH of the electrolyte, the DC voltage or DC pulse voltage, the current, and the cathode material. These parameters can be adjusted individually or in a chosen combination to achieve the desired result. It should be recognized that this a strength of the methods and apparatus of this disclosure compared to other methods where such selective removal of layers is not possible.

The PECCR treatment of this disclosure can be useful in achieving removal of electrically conductive coatings of metallic components used in many industrial operations. A non-limiting example is metal forming operation.

Based on the above detailed description, it is an objective of this disclosure to describe a method of removing an electrically conductive coating from a metallic component. The method includes providing a tank containing a liquid electrolyte and a cathode immersed in the liquid electrolyte. The metallic component containing the conductive coating is immersed into the liquid electrolyte to act as an anode. A DC power supply is connected to the anode and cathode to form an electrolytic cell capable of producing a plasma on the metallic component with the conductive coating. The DC power supply is activated to produce a plasma on the metallic component with the conductive coating for a duration such that the conductive coating from the metallic component disintegrates into particles partially or fully.

In some embodiments of the method of this disclosure, the disintegrated particles fully dissolve in the liquid electrolyte, while in certain other embodiments, the particles partially dissolve in the liquid electrolyte. In some embodiments, the particles are suspended in the liquid electrolyte while in certain other embodiments the particles settle to bottom of the tank containing the liquid electrolyte. In some embodiments, particles can be suspended in the electrolyte as well as settled in bottom of the tank containing the liquid electrolyte. It should be recognized that different particles may behave differently in terms of dissolution, suspension in the liquid and settling in the tank. It should be recognized, for purposes of this disclosure dealing with particle disintegration, the term particle, as explained earlier, may mean one or more of the following: particles, agglomerates and chunks.

In some embodiments of the method, of this disclosure, the liquid electrolyte is an aqueous solution of a salt. Salts suitable for this purpose include but not limited to ammonium salts, sodium salts, and potassium salts. Non-limiting examples of ammonium salts are: ammonium chloride, ammonium fluoride, ammonium sulfate, ammonium hydrogen carbonate, ammonium carbonate, ammonium oxalate, ammonium formate, ammonium acetate, ammonium nitrate, ammonium citrate, ammonium hydrogen citrate, ammonium dihydrogen citrate, ammonium phosphate, ammonium hydrogen phosphate, and ammonium dihydrogen phosphate. Non-limiting examples of sodium salts suitable for the apparatus of this disclosure are sodium chloride, sodium fluoride, sodium sulfate, sodium hydrogen carbonate, sodium carbonate, sodium oxalate, sodium formate, sodium acetate, sodium nitrate, sodium citrate, sodium hydrogen citrate, sodium dihydrogen citrate, sodium phosphate, sodium hydrogen phosphate, and sodium dihydrogen phosphate. Non-limiting examples of potassium salts suitable for the apparatus of this disclosure are potassium chloride, potassium fluoride, potassium sulfate, potassium hydrogen carbonate, potassium carbonate, potassium oxalate, potassium formate, potassium acetate, and potassium nitrate, potassium citrate, potassium hydrogen citrate, potassium dihydrogen citrate, potassium phosphate, potassium hydrogen phosphate, and potassium dihydrogen phosphate.

In some embodiments of the method, more than one salt can be used. A non-limiting example of using more than one salt can include usage of one of an ammonium salt, a sodium salt and a potassium salt. Non-limiting examples of using two salts include use of an ammonium salt and a sodium salt;

and, an ammonium salt and a potassium salt. Another non-limiting example of using two salts is the usage of ammonium hydrogen citrate and sodium dihydrogen citrate.

Materials suitable for a cathode of this method include, but not limited to stainless steel, such as, but not limited to SS316. In some embodiments of the method, the metallic component which contains the conductive coating can be made of an alloy. In some embodiments, the alloy can be a steel alloy, such as, but not limited to D2 and High-Speed Steels (HSS) known to those skilled in the art. In some embodiments of the method, the DC or pulsed DC power supply is capable of producing 1000 Volts. In some embodiments of the apparatus, a draining and filtration system for the liquid electrolyte, capable of capturing the particles of the conductive coating falling into the liquid electrolyte, can be incorporated. In some embodiments of the method, the metallic component is an aircraft component. In some preferred embodiments, the metallic component is or part of an aircraft wheel. In some embodiments, the tool comprises a steel alloy, such as but not limited to D2. In some embodiments of the method, the duration of activating the DC power supply is in the range of 3-8 minutes.

It is also an objective of this disclosure to describe another method of removing conductive coating from a metallic component. The method includes providing a tank containing an aqueous solution of ammonium hydrogen citrate in the range of 1-28%, sodium dihydrogen citrate in the range of 1-10%, and potassium hydrogen phosphate in the range of 0.5-10%, as a liquid electrolyte with a pH of 8, and 316 SS as cathode immersed in the liquid electrolyte, immersing a metallic component made of a steel alloy, such as but not limited to 316 SS or D2, containing the conductive coating to be removed into the liquid electrolyte to act as an anode, providing a DC power supply connected to the anode and cathode to form an electrolytic cell capable of producing a plasma on the metallic component with conductive coating, and activating the DC power supply producing a voltage of more than 150 volts to produce a plasma on the metallic component with the conductive coating for a duration in the range of 3-8 minutes such that the conductive coating from the metallic component disintegrates into particles falling into the liquid electrolyte, thereby resulting in a metallic component without the conductive coating.

Based on the above detailed description, it is yet another objective of this disclosure to describe an apparatus for removing electrically conductive coatings or layers from a metallic component. The apparatus includes a tank containing a liquid electrolyte, a cathode immersed in the liquid electrolyte, a metallic component with a conductive coating acting as an anode immersed in the liquid electrolyte, and a DC or pulsed DC power supply connected to the anode and cathode to form an electrolytic cell, wherein the electrolytic cell is capable of producing a plasma on the metallic component containing a conductive coating, such that the electrically conductive coating from the metallic component disintegrates into disintegrates into particles partially or fully.

In some embodiments of the apparatus of this disclosure, the liquid electrolyte is an aqueous solution of a salt. Salts suitable for this purpose include but not limited to ammonium salts, sodium salts, and potassium salts. Non-limiting examples of ammonium salts are: ammonium chloride, ammonium fluoride, ammonium sulfate, ammonium hydrogen carbonate, ammonium carbonate, ammonium oxalate, ammonium formate, ammonium acetate, ammonium nitrate, ammonium citrate, ammonium hydrogen citrate, ammonium dihydrogen citrate, ammonium phosphate, ammonium hydrogen phosphate, and ammonium dihydrogen phosphate. Non-limiting examples of sodium salts suitable for the apparatus of this disclosure are sodium chloride, sodium fluoride, sodium sulfate, sodium phosphate, sodium hydrogen carbonate, sodium carbonate, sodium oxalate, sodium formate, sodium acetate, sodium nitrate, sodium citrate, sodium hydrogen citrate, and sodium dihydrogen citrate. Non-limiting examples of potassium salts suitable for the apparatus of this disclosure are potassium chloride, potassium fluoride, potassium sulfate, potassium hydrogen carbonate, potassium carbonate, potassium oxalate, potassium formate, potassium acetate, potassium nitrate, sodium citrate, sodium hydrogen citrate, and sodium dihydrogen citrate, potassium phosphate, potassium hydrogen phosphate, and potassium dihydrogen phosphate.

In some embodiments of the apparatus, more than one salt can be used. A non-limiting example of using more than one salt can include usage of an ammonium salt, a sodium salt and a potassium salt or combinations thereof. Non-limiting example of using two salts include an ammonium salt and a sodium salt; an ammonium salt and a potassium salt; and, an ammonium hydrogen citrate and sodium dihydrogen citrate.

Materials suitable for a cathode of this apparatus include, but not limited to stainless steel, such as, but not limited to SS316. In some embodiments of the apparatus, the metallic component from which a conductive coating is removed can be made of an alloy. In some embodiments, the alloy can be a steel alloy, such as, but not limited to D2. In some embodiments of the apparatus, the DC or pulsed DC power supply is capable of producing 1000 Volts.

In certain embodiments of the apparatus of this disclosure, the apparatus contains a draining and filtration system for the liquid electrolyte capable of capturing the particles falling into the liquid electrolyte.

It should be recognized that the methods and apparatus of this disclosure differ from those known to people skilled in the art, in that the methods and apparatus of this disclosure include generation of plasma, environmentally benign electrolytes for ease of use and disposition and notable shorter durations to remove the electrically conductive coatings. Also, the methods of the present disclosure differ from those previously known to people skilled in the art in that the coating removal process is a one-step process as opposed to some processes described in literature that include two or more steps depending on the type and degree of oxidation layers etc. Thus, the present method and apparatus offer safer, more environmentally friendly, faster, and less cumbersome processes for removal of electrically conductive components on metallic components.

The scope of this disclosure is not limited to steels, High-Speed Steels (HSS) and stainless-steel alloys as the materials from which removal of a conductive coating is achieved. Components made of other materials such as titanium alloys and nickel alloys are also suitable for subjecting to the PECCR treatment described in this disclosure. Further, the power supply can be configured to provide DC or pulsed DC voltages up to 1000 Volts nominal but can be smaller or greater than 1000 volts as required for the operation. The pH of the electrolyte can vary in the range of 3-9. Further, it should be stressed that, while several embodiments described in this disclosure make reference to DC power supply, it is an objective of this disclosure to assert that pulsed DC supply can be employed in place of DC power supply in all the embodiments of this disclosure.

It should be recognized that the methods and apparatus of this disclosure are applicable to a variety of metallic components in a variety of applications and industry. A non-limiting example of an industry is the tooling industry wherein many metallic components such as, but not limited to drills and dies, require removal of conductive coatings. Similarly, many equipment including but not limited to military equipment such as, but not limited to weapons systems, have metallic components that need to be stripped of the conductive coatings. In all the applications, the methods and apparatus of this disclosure are applicable to a variety of metals and alloys. That is, the metallic components from which a conductive coating is intended to be removed, in tooling or other industries, can be made of steel, HSS, titanium, nickel or other metals and alloys.

In some situations, such as for inspection of high stress areas for cracks, it may be required that conductive coatings be removed from a metallic component only in selected areas. Such selective removal of conductive coatings can be achieved by suitably masking the anode (masking methods are known to those skilled in the art) thereby preventing the masked areas from the effects of plasma and hence removal of conductive coating.

While the invention has been described in terms of specific embodiments, including particular configurations, it is apparent that other forms could be adopted by one skilled in the art. Accordingly, it should be understood that the invention is not limited to the specific disclosed embodiments. Other implementations are possible. Therefore, the scope of the invention is to be limited only by the following claims.

The invention claimed is:

1. A method of removing electrically conductive coating from a metallic component, the method comprising:

providing a tank containing a liquid electrolyte and a cathode immersed in the liquid electrolyte;

immersing a metallic component containing more than one conductive coating into the liquid electrolyte to act as an anode;

providing a DC power supply connected to the anode and cathode to form an electrolytic cell capable of producing a plasma on the metallic component containing more than one conductive coating; and activating the DC power supply to produce the plasma on the metallic component containing more than one conductive coating for a duration such that one of the conductive coating from the metallic component disintegrates into particles partially or fully in response to values selected for voltage and current of the DC power supply, pH of the liquid electrolyte, and material of the cathode.

2. The method of claim 1, where in the disintegrated particles i) fully dissolve in the liquid electrolyte, or ii) partially dissolve in the liquid electrolyte or iii) are suspended in the liquid electrolyte or iv) settle to bottom of the tank containing the liquid electrolyte, or v) contain particles suspended in the electrolyte and particles settled in bottom of the tank containing the liquid electrolyte.

3. The method of claim 1 wherein the liquid electrolyte is an aqueous solution of one of an ammonium salt, a potassium salt and a sodium salt.

4. The method of claim 3, wherein the cathode is made of a stainless-steel SS 316.

5. The method of claim 1, wherein metallic component containing a conductive coating comprises a steel alloy.

6. The method of claim 1, wherein the DC power supply is capable of producing voltages up to 1000 volts.

7. The method of claim 1, the duration is in the range of 3-8 minutes.

8. The method of claim 1 wherein the liquid electrolyte is an aqueous solution of two or more salts.

9. The method of claim 8, wherein the two salts are ammonium citrate and sodium dihydrogen citrate.

10. A method of removing a conductive coating from a metallic component, the method comprising:

providing a tank containing an aqueous solution of ammonium citrate, sodium dihydrogen citrate, and potassium citrate, the aqueous solution acting as liquid electrolyte, and a cathode made of 316 SS immersed in the liquid electrolyte;

immersing the metallic component containing more than one electrically conductive coating into the liquid electrolyte to act as an anode;

providing a DC power supply capable of producing at least 150 volts connected to the anode and cathode to form an electrolytic cell capable of producing a plasma on the metallic component containing more than one electrically conductive coating; and activating the DC power supply to produce a plasma on the metallic component containing more than one electrically conductive coating for a time period in the range of 3-8 minutes such that one of the more than one conductive coating on the metallic component partially or fully disintegrates into particles wherein the particles i) fully dissolve in the liquid electrolyte, or ii) partially dissolve in the liquid electrolyte or iii) are suspended in the liquid electrolyte or iv) settle to bottom of the tank containing the liquid electrolyte, or v) contain particles suspended in the electrolyte and particles settled in bottom of the tank containing the liquid electrolyte, in response to values selected for voltage and current of the DC power supply, pH of the liquid electrolyte, and material of the cathode.

11. An apparatus for removing an electrically conductive coating from a metallic component comprising:

a tank containing a liquid electrolyte;

a cathode immersed in the liquid electrolyte;

the metallic component coated with more than one electrically conductive coating acting as an anode immersed in the liquid electrolyte; and a DC power supply connected to the anode and cathode to form an electrolytic cell, the electrolytic cell being capable of producing a plasma on the coated metallic component, such that the one of the more than one electrically conductive coating from the metallic component disintegrates into particles falling into the liquid electrolyte, in response to values selected for voltage and current of the DC power supply, and pH of the liquid electrolyte, and material of the cathode.

12. The apparatus of claim 11, wherein the liquid electrolyte is an aqueous solution of at least one salt.

13. The apparatus of claim 11, wherein the at least one salt is one of an ammonium salt, a sodium salt and a potassium salt.

14. The apparatus of claim 11, wherein the at least one salt is two salts.

15. The apparatus of claim 13, wherein the two salts are an ammonium salt and a sodium salt.

16. The apparatus of claim 13, wherein the two salts are an ammonium salt and a potassium salt.

17. The apparatus of claim 13, wherein the two salts are a sodium salt and a potassium salt.

18. The apparatus of claim 11, wherein the cathode is made of stainless steel SS 316.

19. The apparatus of claim 11, wherein the coated metallic component is one of stainless steel and tool steel.

20. The apparatus of claim 11, wherein the DC power supply is capable of producing 1000 volts.

21. The apparatus of claim 11, further comprising a draining and filtration system for the liquid electrolyte capable of capturing the particles falling into the liquid electrolyte.

* * * * *